US010634136B2

(12) United States Patent
Pippes et al.

(10) Patent No.: US 10,634,136 B2
(45) Date of Patent: Apr. 28, 2020

(54) GEARED FLUID MACHINE WITH CIRCUMFERENTIAL SEAL HAVING FIRST AND SECOND SPACED APART SEAL LIMBS

(71) Applicant: Eckerle Industrie-Electronik GmbH, Malsch (DE)

(72) Inventors: Reinhard Pippes, Bretten (DE); Artur Bohr, Stuttgart (DE)

(73) Assignee: ECKERLE TECHNOLOGIES GMBH, Malsch (DE)

( * ) Notice: Subject to any disclaimer, the term of this patent is extended or adjusted under 35 U.S.C. 154(b) by 261 days.

(21) Appl. No.: 15/658,914

(22) Filed: Jul. 25, 2017

(65) Prior Publication Data

US 2018/0030982 A1 Feb. 1, 2018

(30) Foreign Application Priority Data

Jul. 26, 2016 (DE) ..... 10 2016 213 696

(51) Int. Cl.
*F01C 19/00* (2006.01)
*F03C 2/00* (2006.01)
(Continued)

(52) U.S. Cl.
CPC ..... *F04C 15/0026* (2013.01); *F01C 19/085* (2013.01); *F04C 2/101* (2013.01);
(Continued)

(58) Field of Classification Search
CPC .. F04C 2/101; F04C 2/103; F04C 2/18; F04C 2240/30; F04C 15/0026; F01C 19/085
(Continued)

(56) References Cited

U.S. PATENT DOCUMENTS 3,097,893 A * 7/1963 White ..... F16C 33/201 384/151
3,768,819 A * 10/1973 Burkert ..... F16J 15/025 277/647
3,895,890 A 7/1975 Laumont
4,029,446 A 6/1977 Mayer et al.
5,232,356 A 8/1993 Takeda et al.
(Continued)

FOREIGN PATENT DOCUMENTS

DE 7500496 U 7/1976
DE 4322239 A1 * 1/1995 ..... F03C 2/08
(Continued)

OTHER PUBLICATIONS

European Search Report for parallel application EP 17182228.1, EPO/Munich, dated Oct. 6, 2017.

*Primary Examiner* — Theresa Trieu
(74) *Attorney, Agent, or Firm* — Stephen T. Olson; Harness, Dickey & Pierce, P.L.C.

(57) ABSTRACT

A geared fluid machine has a machine housing and first and second intermeshing gearwheels that are rotatably mounted in the machine housing with respect to an axis of rotation and are arranged at least partially contacting by their end faces. At least one axial washer is arranged in the machine housing with axial play and has on a distal side a pressure field surrounded by a circumferential seal. The seal contacts and seals against a first bearing surface of the axial washer, and also contacts and seals against a second bearing surface of the machine housing. The seal is at least partially U-shaped in section and has a first seal limb contacting the first bearing surface, a second seal limb contacting the second bearing surface, and a connecting limb connecting the first and second seal limbs.

16 Claims, 5 Drawing Sheets

(51) Int. Cl.

| | |
|---|---|
| ***F03C 4/00*** | (2006.01) |
| ***F04C 2/00*** | (2006.01) |
| ***F04C 15/00*** | (2006.01) |
| ***F01C 19/08*** | (2006.01) |
| ***F04C 2/18*** | (2006.01) |
| ***F04C 2/10*** | (2006.01) |

(52) U.S. Cl.
CPC ..... *F04C 2/103* (2013.01); *F04C 2/18* (2013.01); *F04C 2240/30* (2013.01)

(58) Field of Classification Search
USPC ..... 418/104, 110, 120, 124, 166, 171, 418/130–131, 140, 143, 153, 154; 277/628, 644, 647
See application file for complete search history.

(56) References Cited

U.S. PATENT DOCUMENTS

| | | | | |
|---|---|---|---|---|
| 6,171,089 | B1 | 1/2001 | Oehman, Jr. | |
| 7,171,886 | B2 * | 2/2007 | Herrmann | F41A 3/74 277/644 |
| 2004/0041354 | A1 * | 3/2004 | Derr | F16J 15/061 277/628 |

FOREIGN PATENT DOCUMENTS

| | | | |
|---|---|---|---|
| DE | 102012213771 | A1 | 2/2014 |
| EP | 0291722 | A1 | 11/1988 |
| EP | 0421020 | A1 | 4/1991 |
| EP | 0512514 | A2 | 11/1992 |
| EP | 0512514 | A3 | 11/1992 |
| WO | WO-9112431 | A1 | 8/1991 |

* cited by examiner

GEARED FLUID MACHINE WITH CIRCUMFERENTIAL SEAL HAVING FIRST AND SECOND SPACED APART SEAL LIMBS

CROSS-REFERENCE TO RELATED APPLICATIONS

This Application claims priority to Application DE 102016213696.8, filed on Jul. 26, 2016 in Germany.

The disclosure relates to a geared fluid machine, having a machine housing, a first gearwheel and a second gearwheel which meshes with the first gearwheel, wherein the first gearwheel and the second gearwheel are each rotatably mounted in the machine housing with respect to an axis of rotation and are each arranged at least partially contacting by the end faces thereof at least one axial washer arranged in the machine housing with axial play, said axial washer having on its side which faces away from the gearwheels a pressure field surrounded by a circumferential seal which contacts and seals against a first bearing surface of the axial washer on one side thereof, and on the other side contacts and seals against a second bearing surface of the machine housing.

BACKGROUND

By way of example, the geared fluid machine can be designed as a gear pump or as a gear motor. Likewise, a design as an internal geared fluid machine or as an external geared fluid machine is possible, such that the geared fluid machine can be in the form of an internal gear pump, internal gear motor, external gear pump or external gear motor. In either case, the geared fluid machine comprises the first gearwheel and the second gearwheel. The two gearwheels mesh with each other, wherein the first gearwheel has a first toothing and the second gearwheel has a second toothing, and the two toothings at least partially engage with each other. In the following, the internal geared fluid machine will be discussed purely by way of example. Of course, the details can always be applied directly to an external geared fluid machine.

In the case of the internal geared fluid machine, the first gearwheel is designed as a pinion and the first toothing is designed as an external toothing, whereas the second gearwheel is a ring gear comprising the second toothing which is designed as an internal toothing. The pinion is arranged in the ring gear in such a manner that the two toothings mesh with each other. The pinion in this case is mounted eccentrically with respect to the ring gear. This means that the first gearwheel is rotatably mounted about a first axis of rotation and the second gearwheel is rotatably mounted about a second axis of rotation, the two axes of rotation preferably being arranged parallel to and at a distance from each other. If the geared fluid machine is designed as an external geared fluid machine, the two toothings are arranged as external toothings which mesh with each other. In this case as well, the two axes of rotation are arranged parallel to and at a distance from each other.

In the case of a design of the geared fluid machine as a pump, the gearwheels are subjected to a rotational movement, whereby a conveying effect is exerted on a fluid present in the geared fluid machine. On the other hand, if the geared fluid machine is designed as a motor, fluid is supplied to the same, causing the gearwheels to rotate. A torque, which can be tapped, is therefore made available on one of the gearwheels. The following solely addresses the pump in detail. However, the details given can always be transmitted to the motor.

As essential components, the geared fluid machine comprises the first gearwheel, the second gearwheel and the machine housing. The two gearwheels are rotatably mounted in the machine housing, particularly about the first axis of rotation and the second axis of rotation. To achieve the eccentric mounting of the two gearwheels, the two axes of rotation are arranged at a distance from each other, in particular parallel to each other. In the case of the internal geared fluid machine, the pinion is arranged in the ring gear and accordingly has an outer diameter which is less than an inner diameter of the ring gear. Both the pinion and the ring gear are essentially round in cross-section relative to the respective axis of rotation. The outer diameter of the pinion and the inner diameter of the ring gear are selected in such a manner that the outer toothing of the pinion engages in the circumferential direction with respect to the second axis of rotation only with a region of the internal toothing of the ring gear.

The first gearwheel is, for example, arranged on a drive shaft of the geared fluid machine, in particular connected to it in a torque-proof manner. The first gearwheel can therefore be driven via the drive shaft and made to rotate about the first axis of rotation. On account of the second toothing, which is in engagement with the first toothing, the rotational movement of the first gearwheel is also impressed on the second gearwheel. In the case of the internal gear pump, the first gearwheel is directly driven by the drive shaft, while the second gearwheel is only indirectly driven by the drive shaft via the first gearwheel. Both the first toothing and the second toothing have a plurality of teeth, as well as tooth gaps between the teeth. In the case of the internal gear pump and/or the external gear pump, the conveying effect is achieved by the meshing of the first toothing and the second toothing.

When any given tooth of the first gearwheel is observed during a complete rotation of the first gearwheel, this tooth temporarily engages in a tooth gap of the second toothing. Before the tooth engages in the tooth gap, fluid is present in the latter. As a result of the engagement, the fluid is preferably conveyed to a pressure side and/or into a pressure chamber of the geared fluid machine, particularly from a suction side and/or out of a suction chamber. The pressure chamber is formed, for example, in the machine housing of the geared fluid machine. If the geared fluid machine is designed as a geared fluid motor, the fluid flows from the pressure chamber toward the suction side and/or the suction chamber of the geared fluid machine, thereby driving both the first gearwheel and the second gearwheel. To this extent, the geared fluid motor constitutes the kinematic reversal of the geared fluid pump.

The at least one axial washer is arranged in the machine housing, and lies at least partially against an end face of the first gearwheel and/or an end face of the second gearwheel. The axial washer functions as a seal, in particular of the pressure side against the suction side, such that the fluid present in the geared fluid machine cannot flow past the end face of the first gearwheel and/or the second gearwheel. Of course, an axial washer is preferably arranged on either side of the first gearwheel and the second gearwheel. However, in the following, only one of these axial washers will be discussed, although the details given can always be applied otherwise. By way of example, the axial washers are designed to be symmetric to each other, or are even present as common parts.

In order to always achieve a reliable seal by means of the axial washer, the latter is arranged in the machine housing with axial play with respect to the axis of rotation and/or the axes of rotation. In order to press the axial washer during operation in the axial direction toward the first gearwheel and/or the second gearwheel, in particular against the first gearwheel and/or the second gearwheel, the axial washer has a pressure field on its side facing away from the gearwheels in the axial direction. The pressure field is preferably in the form of a depression in the axial washer which is preferably closed on the edge thereof—that is, possesses a circumferential edge. The depression only partially passes through the axial washer in the direction of the gearwheels—not completely. In this respect, it has a continuous base.

At least during the operation of the geared fluid machine, the pressure field and/or the depression is subjected to the force of pressurized fluid. The fluid in this case is preferably the same as that which is present in the pressure chamber and/or the suction chamber of the geared fluid machine. For example, the pressure field is fluidically connected to the pressure side of the geared fluid machine, particularly via at least one flow channel which is at least partially or completely constructed in the machine housing. Optionally, a throttle and/or a diaphragm can be included in the flow channel in order to adjust the desired pressure in the pressure field.

The pressure field is surrounded by the circumferential seal which is arranged on the axial washer. By way of example, the seal is fixed in a depression of the axial washer and/or a depression of the machine housing. The seal completely surrounds the pressure field and is accordingly designed as a circumferential seal. Observed in the axial direction, the seal lies on one side thereof against a bearing surface of the axial washer, and on the other side thereof against a second bearing surface of the machine housing, wherein the bearing surfaces are preferably arranged parallel to each other. Because of the sealing of the pressure field by means of the seal, the axial washer is pressed by the pressurized fluid present in the pressure field in the direction of the first gearwheel and/or the second gearwheel, such that the axial washer preferably lies against the end face of the first gearwheel—or of the second gearwheel.

By way of example, an internal gear pump is known from DE 10 2012 213 771 A1, having an axial washer which lies against the end faces of a ring gear and of a pinion of the internal gear pump to laterally limit a pump space, and which has a pressure field on an outer side facing away from the ring gear and the pinion, which is sealed with a sealing ring which encloses the pressure field. In this case, the internal gear pump has a sealing arrangement with the sealing ring, which has the shape of a contour of the pressure field and an L-shaped ring cross-section, and with an elastic ring which engages internally in the L-shaped ring cross-section of the sealing ring.

SUMMARY

The problem addressed by the disclosure is that of suggesting a geared fluid machine which has advantages over known geared fluid machines, particularly allowing a better sealing of the pressure field while simultaneously simplifying assembly. The seal is, particularly at least partially, U-shaped in cross-section and has a first sealing limb resting against the first bearing surface, a second sealing limb resting against the second bearing surface, and a connecting limb connecting the first sealing limb and the second sealing limb.

In the context of this description, the seal is at times referenced in section. The section in this case is preferably a seal cross-section which corresponds to a part of a longitudinal section through the seal, wherein the cut plane of this longitudinal section includes the axis of rotation of the first gearwheel and/or the second gearwheel, or at least is arranged parallel to it. The seal cross-section then designates the part of the longitudinal section which is located on one side of an imaginary plane perpendicular to the cut plane. Because the seal has a circumferential design, two of these regions lie opposite the seal in the longitudinal section. As such, when reference is made to the section of the seal, this preferably always means only one of these regions. If the seal is regarded as a circumferential sealing ring with a continuous, particularly curved and/or annular longitudinal center axis, the seal cross-section is a cross-section of the seal with respect to this longitudinal center axis.

Viewed in section, the seal is U-shaped and accordingly has three limbs, particularly the first seal limb, the second seal limb and the connecting limb. The two seal limbs are arranged at a distance from each other when viewed in section, and are connected to each other by the connecting limb. Preferably, the two seal limbs and the connecting limb are designed as a single piece and/or as a uniform material making up the same. The latter case should be understood to mean that the seal limbs and the connecting limb are made of the same material. The seal preferably exclusively comprises the two seal limbs and the connecting limb, such that as a whole the seal consists of only one material, which can also be referred to as a sealing material. The seal has the described shape at least in a part thereof—that is, not necessarily along its entire extent. However, the shape is preferably present along the entire extent of the seal.

Viewed in longitudinal section through the geared fluid machine, the first seal limb then lies against the first bearing surface and the second seal limb lies against the second bearing surface. More specifically, the first seal has a first sealing surface lying against the first bearing surface and the second seal limb has a second sealing surface lying against the second bearing surface. In this case, the two sealing surfaces are preferably each arranged on the outside of the seal, and are therefore arranged, in the longitudinal section through the geared fluid machine, on opposite sides of the seal and/or on opposite sides of the two seal limbs.

Such a configuration of the seal allows a simple adjustment of a spring rate of the seal, which influences the contact pressure of the seal against the axial washer and the machine housing. Depending on production tolerances of the geared fluid machine, for example of the machine housing, of the gearwheels and/or of the axial washer, different pressing forces, corresponding to different axial prestresses of the seal, can result after the assembly of the geared fluid machine, owing to the spring action of the seal.

In the case of known seals, there can be, in extreme cases, either no contact pressure, or very high contact pressure, which can result in various disadvantages, such as, for example, an insufficient sealing effect and associated loss of efficiency of the geared fluid machine, poorer volumetric efficiency, and/or high frictional torque transmitted from the axial washer to the first gearwheel and/or the second gearwheel. The latter causes a deterioration of the hydraulic-mechanical efficiency of the geared fluid machine and possibly even increased wear on a running surface of the axial washer against which lie the respective end faces of the first gearwheel and/or the second gearwheel.

In contrast, the described configuration of the seal enables a geared fluid machine in which the aforementioned problems do not occur because the axial prestress of the seal and consequently the contact pressure of the axial washer against the first gearwheel and/or the second gearwheel have an advantageous course over a spring travel of the seal. This is brought about by an advantageous spring characteristic curve of the seal—that is, the course of the spring force produced by the seal over the spring travel.

In a further embodiment of the disclosure, the seal consists uniformly of an elastic material, in particular of polyurethane, and/or has no support ring. It has already been pointed out above that the two seal limbs and the connecting limb preferably consist of the same material and are designed in a material-uniform manner in this respect. The material used is, for example, polyurethane. In addition or as an alternative, the seal is designed without a support ring—that is, in particular, does not have a washer ring made of metal or another elastic material. Rather, the seal consists exclusively of the sealing material.

Alternatively, of course, a support ring can be functionally assigned to the seal, or the seal can have such a support ring. The support ring is, for example, arranged between the first seal limb and the first bearing surface, and lies against both. Alternatively, it is arranged between the connecting leg and the machine housing, and likewise lies against both. The support ring preferably consists of a material other than the seal—in particular, metal. By way of example, the seal is fastened to the support ring, in particular with a material bond. By way of example, the seal is injection-molded onto the support ring.

In a further embodiment of the disclosure, the seal, viewed in section, is symmetrical with respect to a symmetry plane running at a distance from the seal limbs, in particular centrally, through the connecting limb. The symmetry plane and/or a symmetry line lying in the plane of symmetry and the cross-section plane is preferably perpendicular to the connecting leg. In this case, it is arranged at a distance from both seal limbs. By way of example, it lies centrally between the seal limbs. The seal is then of the same design on both sides of the symmetry plane and/or the symmetry lines. In particular, it is symmetrical with respect to the symmetry plane.

In the case of the central arrangement of the symmetry plane with respect to the seal limbs, this means that the seal limbs each have the same distance from the plane of symmetry and, in addition, are designed identically to each other—particularly having the same dimensions. Such a symmetrical design of the seal enables an extremely simple assembly of the geared fluid machine, which can also be performed mechanically, in particular automatically. This is achieved, in particular, by the one-piece design of the seal, whereby the required sealing effect for the pressure field can be achieved solely by means of the one-piece seal. Therefore, seals which must be installed separately from each other are not necessary—as is known in the prior art.

In a further implementation of the disclosure, the seal limbs, seen in section, have free ends which are sharply inclined away from each other in the direction facing away from the connecting limb when the seal is in the relaxed state. The seal is understood to be in the relaxed state when it is unassembled—that is, for example, when it is in a pre-assembly state just before the seal is installed. The seal, for example, exhibits this state after it has been produced and until it is assembled. A deformation of the seal can occur during assembly. By means of this deformation, the desired prestress of the seal can be achieved, and accordingly the desired contact pressure of the axial washer against the first gearwheel and/or the second gearwheel can be achieved. This contact pressure occurs at least as long as the pressure field is not subjected to pressurized fluid, and is thus not pressurized.

Each of the seal limbs has a free end on its side remote from the connecting limb. The free ends and/or the seal limbs are then sharply inclined away from each other in the direction facing away from the connecting limb, such that—again, as viewed in section—imaginary extensions of the seal limbs intersect each other at a certain angle. In addition, or alternatively, the seal limbs can also be angled with respect to the axis of rotation of the first gearwheel and/or the second gearwheel when in their relaxed state, therefore forming an angle with the same which is greater than 0° and less than 90°. Due to this configuration of the seal, it is compressed in the axial direction with respect to the axis of rotation during the assembly of the geared fluid machine, the free ends of the seal limbs therefore being displaced toward each other. This initiates the prestress of the seal.

In a particularly preferred implementation of the disclosure, the connecting limb, seen in section, has at least on its side remote from the seal limbs an extension in the axial direction with respect to one of the axes of rotation which is lesser than the distance between the first bearing surface and the second bearing surface when the axial washer is lying against the machine housing. In other words, the width of the connecting limb is less than the distance between the bearing surfaces when the axial washer is in contact with the machine housing—that is, is displaced toward the same by a maximum amount. Such a configuration of the seal prevents the spring characteristic of the seal from being too strongly influenced by the connecting limb. If the width of the connecting limb were greater than the distance between the two bearing surfaces when the axial washer is lying on the machine housing, a very steep increase in the spring characteristic would occur when the axial washer moves toward the machine housing during the operation of the geared fluid machine. This can be prevented by the described embodiment.

In a further embodiment of the disclosure, sides of the free ends which face away from each other when the seal is in the relaxed state can have a greater spacing from each other than the first bearing surface and the second bearing surface, in particular when the axial washer is lying against the machine housing. When the seal is in the relaxed state, the two seal limbs are intended to protrude beyond the connecting limb when viewed in section. Thus, in the longitudinal section with respect to the axis of rotation, the distance between the outer sides of the free ends which accordingly face away from each other, said distance corresponding to the maximum dimensions of the seal in the axial direction in this state, should therefore be greater than the distance between the two bearing surfaces, particularly when the axial washer is lying against the machine housing. Accordingly, this distance is greater than the width of the connecting leg.

The distance between the sides of the free ends facing away from each other is preferably understood to be their maximum distance, the latter being determined in a plane perpendicular to the plane of symmetry. The distance corresponds, for example, to the spacing of the bearing surfaces when the axial washer is lying against the machine housing, plus an axial clearance and/or a prestress protrusion. The axial clearance is greater than zero. For example, it is at least 5%, at least 10%, at least 15%, at least 20% or at least 25%, with respect to the spacing of the bearing surfaces. The prestress protrusion is preferably selected in such a manner that the axial washer is subjected to a certain prestress.

Furthermore, in the context of a preferred embodiment of the disclosure, each of the seal limbs, when viewed in section, can be delimited on each of its sides facing the other of the seal limbs, respectively, by a first imaginary line, and on its other side which is opposite the other seal limb by a second imaginary line, wherein the first line and the second line are angled towards each other when the seal is in the relaxed state. The first line defines the sealing surface of the respective seal limb lying against the bearing surface, while the second line defines an inner surface of the respective seal limb facing away from the sealing surface. The two lines each have a non-zero dimension, such that the sealing surface and the inner surface are at least partially flat and/or planar. Preferably, the angle formed by the two lines is identical for the two seal limbs. However, different angles can also be realized. The angle formed is, for example, at least 2.5°, at least 5°, at least 7.5°, at least 10°, at least 15° or at least 20°.

In a preferred embodiment of the disclosure, the connecting limb, when viewed in section, is rectangular and has at least one chamfer or a round edge on its side remote from the seal limbs. The seal is preferably arranged in a recess which is present in the machine housing or the axial washer. Preferably, the recess has a chamfer or round edge adapted to the chamfer or round edge, wherein the adaptation is preferably provided with respect to the shape and/or the dimensions thereof. Particularly preferably, the chamfer or edge of the connecting limb extends continuously after the assembly of the seal from the chamfer or edge of the recess.

For a further embodiment of the disclosure, the connecting limb can have an extension in the radial direction, when viewed in section, which is greater than the extension of the first seal limb and/or the extension of the second seal limb in the axial direction. Preferably, the two seal limbs each extend radially inwards proceeding from the connecting limb. The cross-section described here can thus be understood as a longitudinal section with respect to the axis of rotation. In other words, a material thickness of the connecting limb is then greater than a material thickness of the seal limbs, wherein the same thickness of material is preferably used for the two seal limbs. The material thickness is considered for the connecting leg in the radial direction and for the seal limbs in the axial direction.

Furthermore, in the context of a further embodiment of the disclosure, it is possible for the free ends of the seal limbs to have at least one rounding, when viewed in section which is between the first imaginary line and the second imaginary line, in particular extending from the first imaginary line to the second imaginary line. Viewed in cross-section, the free ends are, by way of example, planar—that is, they are delimited by a line. This line can then be connected to the first line or the second line via the at least one rounding, such that the rounding of the lines extends up to the first line or the second line.

Preferably, such a rounding is provided on either side of the lines, such that a first rounding thus extends from the lines up to the first imaginary line and a second rounding extends from the lines up to the second imaginary line. Alternatively, of course, the two imaginary lines can be connected to each other via only one rounding, such that the rounding extends from the first imaginary line up to the second imaginary line.

The described embodiment is intended for at least one of the seal limbs, and preferably for both seal limbs. The radius of the rounding can be any given radius, in principle. For example, the rounding represents a circular arc section, thus having a consistently constant curvature. The rounding preferably runs tangentially into the first line or the second line, at least on one side, but particularly preferably on both sides.

In a further embodiment of the disclosure, the seal has at least one first seal region and at least one second seal region, wherein the first seal region and the second seal region have different seal cross-sections. As has already been explained above, the seal has a circumferential design. If specifically only one first seal region and one second seal region are included, these transition into each other on both sides. In other words, the first seal region transitions into the second seal region both on one side thereof as well as on the other, wherein a first end of the first seal region transitions into a first end of the second seal region and a second end of the first seal region into a second end of the second seal region.

Of course, a plurality of first seal regions and a plurality of second seal regions can also be present. By way of example, the seal then alternately consists of one of the first seal regions and one of the second seal regions, such that in this respect first seal regions and second seal regions alternate. By way of example, in this case, relative to the routing of the seal, the first seal region and/or the first seal regions each individually and/or as a whole have a smaller extension than the second seal region and/or the second seal regions. Particularly preferably, each of the first seal regions has a smaller extension than each of the second seal regions. The two seal regions—that is the first seal region and the second seal region—can have different properties. Preferably, they differ only with regard to their cross-section—that is, they are differently configured in cross-section. In addition or alternatively, however, they can also differ in material—particularly consisting of different materials.

The seal preferably has the configuration described at the outset, both in the first seal region as well as in the second seal region—that is to say, when viewed in section, is U-shaped and comprises the first seal limb, the second seal limb and the connecting limb connecting the same. Alternatively, however, the seal can also deviate from this shape in one of the seal regions. By way of example, in one of the seal regions, the seal is designed in the form of a block when viewed in section, such that the connecting limb is only in the form of an imaginary shape, and forms a solid block together with the seal limbs. In this case, the otherwise free ends of the seal limbs are connected directly to each other. By way of example, the seal in this case is of a trapezoidal shape—that is, when viewed in section, it is bounded by two opposing parallel lines and two lines which are spaced from each other and which connect these lines to each other and are angled towards each other.

In a particularly advantageous embodiment of the disclosure, the distance between the sides of the free ends of the seal limb which face away from each other when the seal is in the relaxed state is of a first value in the first seal region and a second value in the second seal region which is different from the first value. The cross-sections of the seal thus differ between the two seal regions in terms of the distance present when the seal is in the relaxed state. In the first seal region, the distance should have the first value, and in the second seal region should have the second value. The second value is different from the first value in this case. Most preferably, it is lesser.

In a further advantageous embodiment of the disclosure, the height of the connecting limb has a first value in the first seal region and has a second value which is different from the first value in the second seal region. The height of the connecting limb corresponds to the material thickness of the connecting limb. The height and/or the thickness of the material of the connecting limb of the seal should then be different for the two seal regions. For this purpose, the height of the connecting limb in the first seal region corresponds to the first value, and the second seal region corresponds to the second value. The second value is different from the first value. It is particularly preferred that the second value is smaller than the first value.

Particularly preferred is an embodiment according to which the first seal region and second seal region differ both in terms of the distance between the sides of the free ends of the seal limb which face away from each other when the seal is in a relaxed state, as well as in terms of the height of the connecting limb. By way of example, the first value is less than the second value for the distance, whereas for the height, the first value is greater than the second value. It is particularly preferred that the values for the distance and the height are selected such that it is possible to achieve the same spring rates of the seal and/or its seal limbs acting between the machine housing and the axial washer.

In a further implementation of the disclosure, the first seal region and the second seal region transition into each other via a transition region. The transition region is accordingly located between the first seal region and the second seal region. By way of example, such a transition region is included for each transition between a first seal region and a second seal region and/or vice versa, such that there is such a transition region between each first seal region and the one or more second seal regions directly adjacent thereto.

In the transition region, the cross-sections of the first seal region and the second seal region gradually conform to each other. Therefore, over the extent of the transition region, the distance between the sides of the free ends facing away from each other, and/or the height of the connecting limb change proceeding from the first seal region to the second seal region. Alternatively, of course, the first seal region and the second seal region can directly adjoin each other—that is, directly transition into each other and/or merge with each other.

Finally, in a further embodiment of the disclosure, the first seal region and the second seal region can be connected to each other via a bend, wherein the bend has a greater curvature than the first seal region and the second seal region. Along the seal, the same has a curvature value which can also be equal to zero, such that the seal runs straight. The more the curvature value differs from zero, the more pronounced is the curvature.

The first seal region and second seal regions are then connected to each other via the bend. The bend can coincide, by way of example, with the transition region, and/or the transition region can constitute the bend. The bend is distinguished by a greater curvature compared to the first seal region and the second seal region, such that the curvature value for the bend is therefore, in absolute terms, greater than for the first seal region and second seal region—in each case viewed over their entire extent. By way of example, the first seal region and the second seal region form an angle to each other at their ends which are adjacent to the bend which is preferably not more than 135°, not more than 90°, or not more than 45°, but in any case is greater than 0°. For example, the angle is at least 45° and at most 135°, at least 60° and at most 120°, at least 75° and at most 105°, or approximately or exactly 90°.

By way of example, the seal extends in the first seal region almost straight, thus having a relatively small curvature—in particular in comparison with the second seal region which is preferably curved more strongly than the first seal region. In other words, the greatest curvature of the first seal region is less than the greatest curvature of the second seal region, which is in turn less than the greatest curvature of the bend.

The disclosure is explained in greater detail below with reference to the embodiments shown in the drawings, without limiting the disclosure as such.

DETAILED DESCRIPTION

Figure 1:
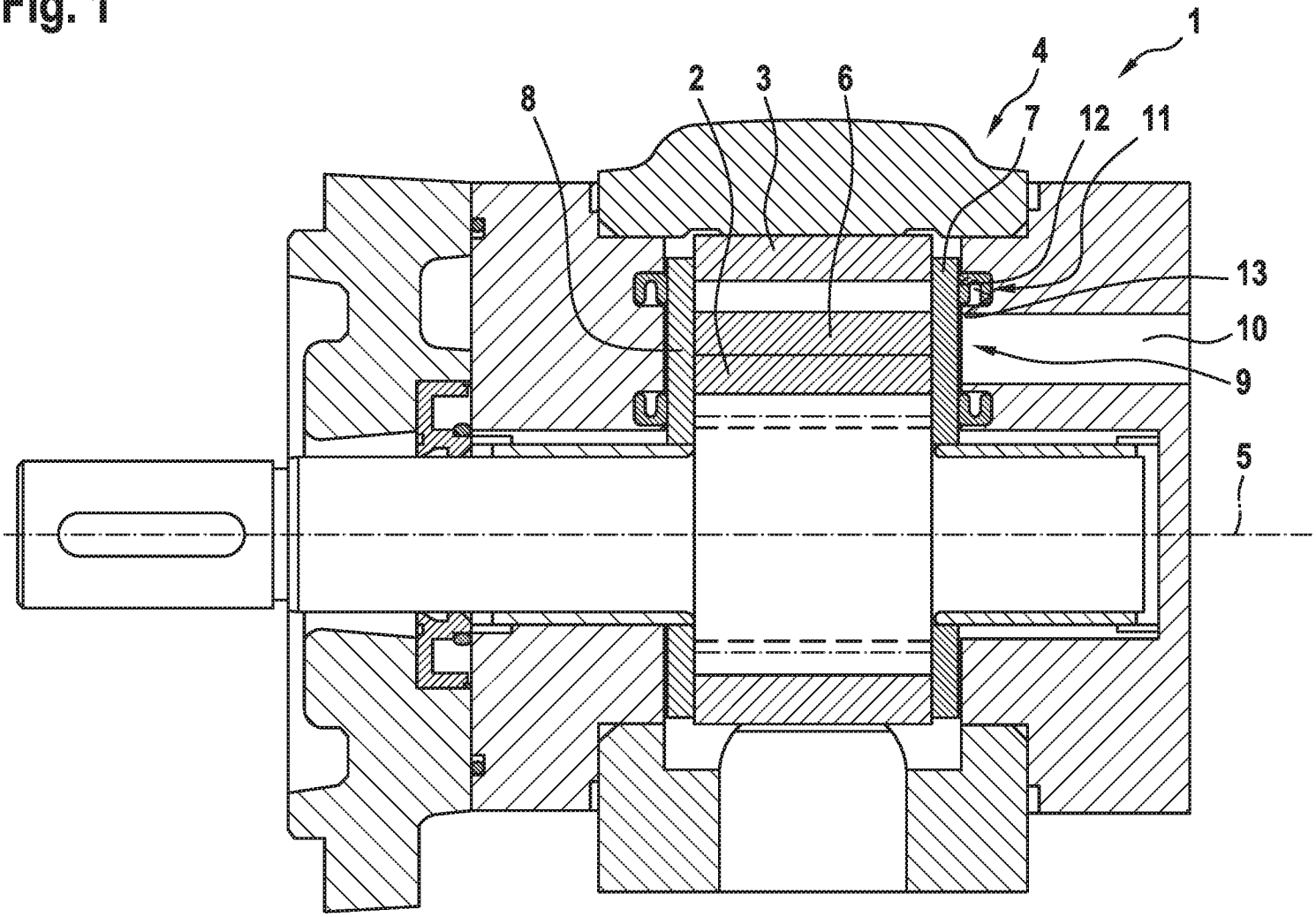
FIG. 1 shows a schematic longitudinal sectional view through a portion of a geared fluid machine.

FIG. 1 shows a schematic longitudinal sectional view of a geared fluid machine 1 which is configured as an internal geared fluid pump, by way of example. The geared fluid machine 1 has a first gearwheel 2 designed as a pinion, a second gearwheel 3 designed as a ring gear, and a machine housing 4. The first gearwheel 2 has an external toothing, which is not illustrated in greater detail, which partially meshes with an internal toothing, which is not illustrated in greater detail, of the second gearwheel 3. The first gearwheel 2 is rotatably mounted with respect to an axis of rotation 5, and the second gearwheel 3 is rotatably mounted about a further axis of rotation which is not illustrated, which is arranged parallel to and at a distance from the axis of rotation 5. The gearwheels 2 and 3 are thus mounted eccentrically to each other. the outer toothing of the first gearwheel 2 is at least partially spaced apart from the internal toothing of the second gearwheel 3. A filling piece 6 which is preferably crescent shaped can be arranged in this region. The filling piece 6 can be designed as a single piece or as multiple pieces.

The axial washer 7 has, on a first washer side facing the machine housing 4, and therefore the gearwheels 2 and 3, a pressure field 9 which is formed by way of example in the form of a depression in the axial washer 7. The pressure field 9 can be subjected via a fluid channel 10 which is formed in the machine housing 4 to a pressurized fluid. By way of example, the pressure field 9 is connected via the fluid channel 10 to the flow of a pressure side, not illustrated here in greater detail, of the geared fluid machine 1. During operation of the geared fluid machine 1, the pressure field 9 is therefore pressurized via the fluid channel 10 and accordingly pressed axially in the direction of the gearwheels 2 and 3.

In order to ensure reliable pressure buildup in the pressure field 9, a seal 11 is functionally assigned to the pressure field. The seal 11 preferably completely surrounds the pressure field 9 and in this respect is annular, if not necessarily circular. Rather, the seal 11 can be out of round—that is, can deviate from a circular shape. by way of example, the pressure field 9 and/or the corresponding depression has an approximately kidney-shaped design, such that the seal 11 is arranged in the shape of a kidney. The seal 11 lies on one side thereof against a first bearing surface 12 of the axial washer 7, sealing the same, and on the other side thereof against a second bearing surface 13 of the machine housing 4, sealing the same. The seal 11 is made of an elastic material, such that after assembly of the geared fluid machine 11, a prestress can be applied to the axial washer 7 with the aid of the seal 11, which in turn produces a certain pressing force of the axial washer 7 on the gearwheels 2 and 3 in the axial direction.

Figure 2:
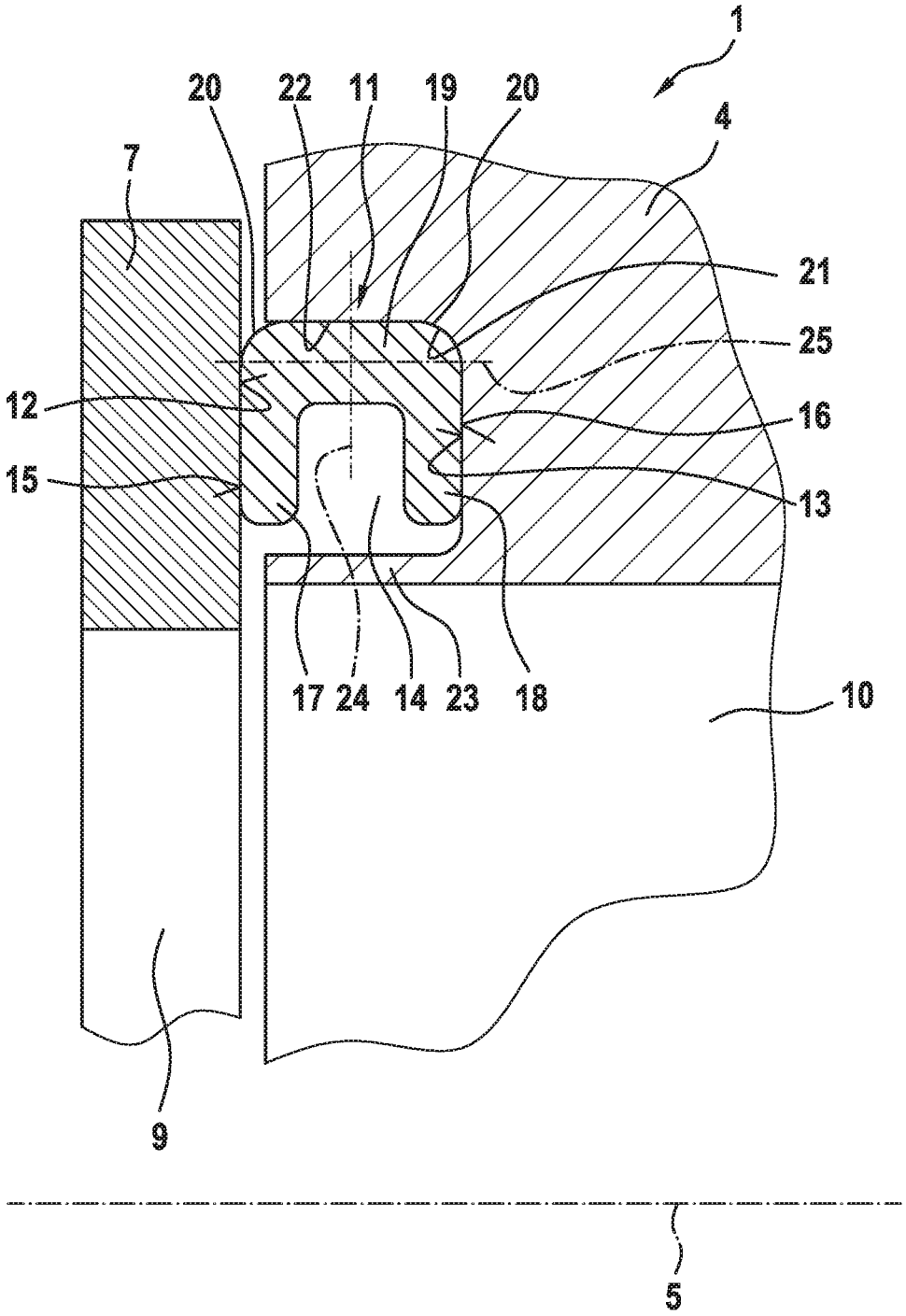
FIG. 2 shows an enlarged detail of the longitudinal section view.

FIG. 2 shows a detail view of the longitudinal sectional view of the geared fluid machine 1 noted above. In particular, the machine housing 4 and the axial washer 7 can be seen partially, and the seal 11 can be seen in its entirety. It can be seen that the seal 11 is arranged in a recess 14 of the machine housing 4. The seal 11 is positioned with a first seal side or a first sealing surface 15 lying against and sealing the first bearing surface 12, and with a second seal side or a second sealing surface 16 lying against and sealing the second bearing surface 13. The first sealing surface 15 is present at a first seal limb 17, while the second sealing surface 16 is formed on a second seal limb 18. The two seal limbs 17 and 18 are arranged spaced apart from each other in the axial direction with respect to the axis of rotation 5, and connected via a connecting limb 19 together, such that the seal 11 is u-shaped overall in cross-section.

The seal 11 is—as indicated by the hatching—constructed in one piece and of a uniform sealing material. Polyurethane can be used as a sealing material, by way of example. In particular, the seal 11 is designed with no support ring—that is, it does not have a metal supporting ring, for example. In this regard, the seal 11 consists solely of the sealing material. Alternatively, of course, a support ring as such can be included. The connecting limb 19 is substantially rectangular as seen in section, and has rounded edges 20 on its sides which face away from the seal the limbs 17 and 18. One of the round edges 20 abuts a corresponding round edge 21 of the recess 14.

It will be appreciated that the recess 14 has greater dimensions than the seal 11 in the radial direction with respect to the axis of rotation 5. Due to the design of the seal 11 as a circumferential seal, the latter has an inherent spring force, which is directed to an enlargement in the radial direction, such that the seal 11 and/or its connecting limb 19 is always pressed against a step 22 which delimits the outward radial extent of the recess 14. On the side opposite the step 22 in the radial direction, the recess 14 is limited by a web 23 which separates the recess 14 from the fluid channel 10. However, the web 23 is optional and may be omitted accordingly.

It can be clearly seen that the seal 11, as seen in section, is constructed symmetrically with respect to a plane of symmetry 24, wherein the plane of symmetry 24 is preferably perpendicular to the axis of rotation 5 and is arranged centrally between the seal limbs 17 and 18. In other words, the plane of symmetry 24 is perpendicular to a longitudinal central axis 25 of the connecting limb 19.

Figure 3:
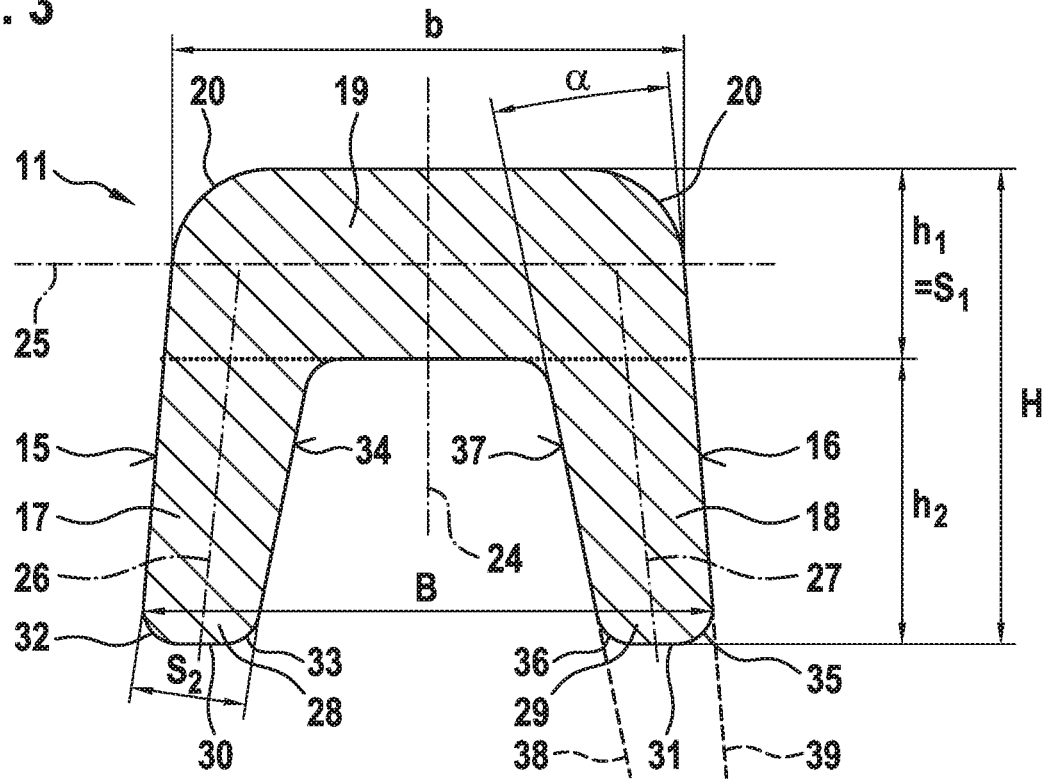
FIG. 3 shows a sectional view of a seal in a first embodiment.

FIG. 3 shows a section of the seal 11 in a first embodiment, wherein the seal 11 is in the unassembled state—that is, in particular in a pre-assembly state. Accordingly, the seal 11 is relaxed, such that the seal limbs 17 and 18, due to their spring action, continue away from each other in the axial direction on their side which face away from the connecting limb 19, such that their distance in this direction increases with increasing distance from the connecting limb 19. The plane of symmetry 24 and the longitudinal central axis 25 are also indicated. Likewise, central longitudinal axes 26 and/or 27 are indicated for each of the seal limbs 17 and 18, respectively. Furthermore, an imaginary logical separation is shown between the seal limbs 17 and 18 on the one hand and the connecting limb 19 on the other. It can therefore be seen that the connecting limb 19 constitutes a kind of base body of the seal 11 from which proceed the seal limbs 17 and 18, the same extending inwardly in the radial direction, by way of example, as viewed in longitudinal section with respect to the axis of rotation 5.

Each of the seal limbs 17 and 18 comprises a free end 28 and/or 29 on its side facing away from the connecting limb 19. The seal 11 has, when viewed in section, a maximum width B, particularly on its side facing away from the connecting limb 19. The maximum width B accordingly corresponds to the maximum spacing of the seal limbs 17 and 18 and/or the maximum spacing of the sealing surfaces 15 and 16. The connecting limb 19, however, has a width b, which may be defined, for example, as the average width, or the width in the region of its longitudinal central axis 25. The width b is smaller than the width B. Furthermore, the width b of the connecting limb 19 is preferably less than or equal to a width of the recess 14 in which the seal 11 is arranged. The opposite configuration from that described above is of course feasible as well. In this case, the width b is greater than the width of the recess 14 and/or is greater than its extension in the axial direction relative to the axis of rotation 5.

On its side facing away from the connecting limb 19, the seal limbs 17 and 18 are each delimited by a flat surface defined by a line 30 and/or 31. When seen in section, the line 30 is bound on one side via a rounding 32 to the first sealing surface 15 and/or to a line which defines the same, while on the other side it is bound via a rounding 33 to an inner surface 34 of the first seal limb 17 and/or to a line which defines the same. This applies analogously to the second seal limb 18; roundings 35 and 36 and an interior surface 37 are present. Each of the seal limbs when viewed in section is delimited on its side facing the other of the seal limbs 18 and/or 17 by the respective inner surface 34 and/or 37, and on its side which faces away from the other seal limb 18 and/or 17, respectively, by the respective sealing surface 15 and/or 16.

For the second seal limb 18, an indication is included that the inner surface 37 is defined by a first line 38, and the sealing surface 16 is defined by a second line 39. The two lines 38 and 39, and thus extensions of the sealing surface 16 and the inner surface 37 are angled toward each other, and thus intersect each other at an angle $\alpha$. The angle $\alpha$ can in principle be selected as desired. For example, it is at least 2.5°, at least 5°, at least 7.5° or at least 10°. The seal 11 is preferably designed in such a manner that the two lines 38 and 39 and/or the sealing surface 16 and the inner surface 37 are angled toward each other when the seal 11 is in the relaxed state, but together form a smaller angle, or are arranged in parallel, after the installation of the seal in the geared fluid machine 1.

In the direction of the plane of symmetry 24 and/or in a direction perpendicular to the longitudinal central axis 25, the seal 11 has a height H. This is composed of a height $h_1$ of the connecting limb 19 and a height h2 of the seal limbs 17 and 18. The height $h_1$ corresponds at the same time to a material thickness s1 of the connecting limb 19—that is, in particular, its extension in the plane of symmetry 24 in cross-section. It can be clearly seen that the height h2 is greater than the height $h_1$, wherein, for example, the height h2 is greater by at least 25%, at least 50%, at least 75% or at least 100% than the height $h_1$. Additionally or alternatively, the material thickness s1 of the connecting limb 19 is greater than a material thickness s2 of the seal limbs 17 and 18. In other words, the extension of the connecting limb 19 in the radial direction with respect to the axis of rotation 5 is greater than the extension of the seal limbs 17 and 18 in the axial direction. By way of example, the material thickness s1 is at least 5%, at least 10%, at least 15%, at least 20% or at least 25% greater than the material thickness s2. Preferably, the ratio between the height H and the width b and/or the width B is chosen such that a removal from the mold of the seal 11 is possible without moving mold elements.

Figure 4:
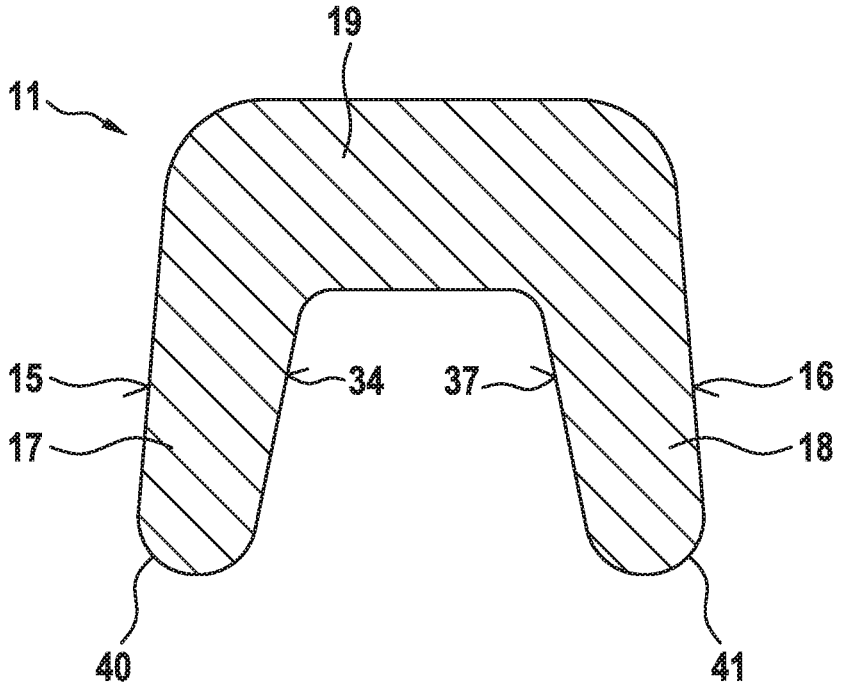
FIG. 4 shows a sectional view of a second embodiment of the seal.

FIG. 4 shows a sectional view of a second embodiment of the seal 11. Reference is hereby made to the foregoing details concerning the first embodiment in their entirety; only the differences are addressed in the following. These difference are that the free ends 28 and 29 of the seal limbs 17 and 18 are not delimited by lines 30 and 31; rather, the free ends 28 and 29 have continuous curves 40 and 41. Each of the curves 40 and 41 proceeds from the respective sealing surface 15 and/or 16 and extends up to the respective inner surface 34 and/or 37. The curves 40 and 41 are designed, by way of example, as segments of a circle, and are of such a size that they merge tangentially on one side into the sealing surface 15 and/or 16, and on the other side into the inner surface 34 and/or 37.

Figure 5:
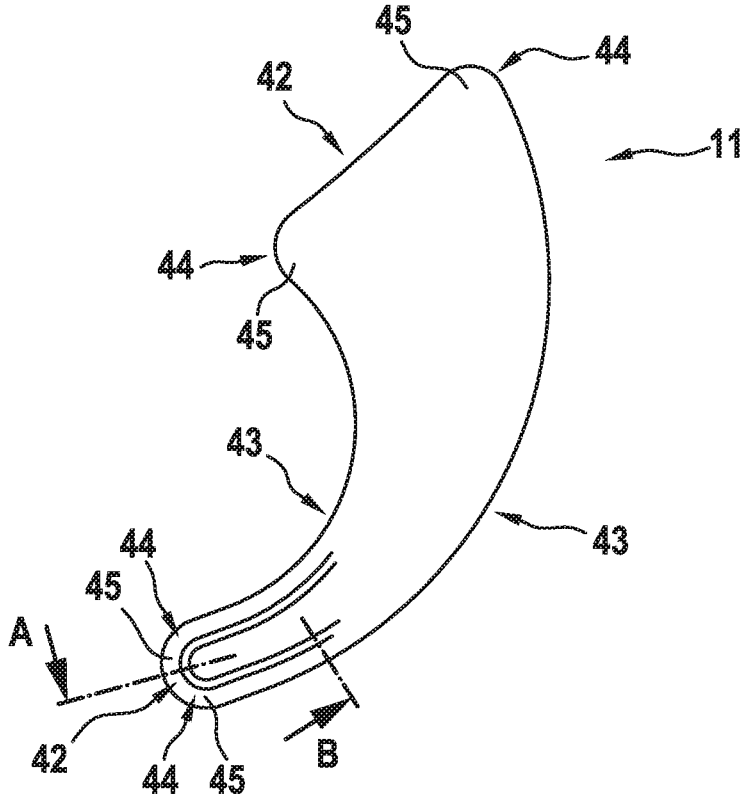
FIG. 5 shows a schematic view of the seal in plan view.

FIG. 5 shows a schematic illustration of the seal 11, wherein it can be seen that it has at least one first seal region 42 and one second seal region 43—in the embodiment illustrated here, two first seal regions 42 and two second seal regions 43. The seal regions 42 and 43 differ in particular with respect to their curvature. Preferably, the first seal region 42 is less curved than the second seal region 43. In instances where this description only discusses one of the first seal regions 42 and/or one of the second seal regions 43, the remarks preferably always apply analogously to each of the first seal regions 42 and/or each of the second seal regions 43.

The first seal region 42 transitions into the second seal region 43 via a transition region 44. In particular, such a transition region 44 is included between each of the first seal regions 42 and each of the second seal regions 43 adjacent to the same. In the transition region 44 and/or in each of the transition regions 44, the seal has a bend 45. The bend 45 realizes, in comparison with the first seal region 42 and the second seal region 43, a greater curvature. Preferably, the curvature of the seal 11 in the bend 45 is stronger than over the entire first seal region 42 and/or the entire second seal region 43. Furthermore, the curvature of the second seal region 43 is preferably continuous throughout, and greater than in the first seal region 42. Preferably, the first seal region 42 has a straight profile, at least partially or even continuously.

The first seal region 42 differs from the second seal region 43 particularly with respect to the seal cross-section. The transition region 44 can therefore be designed in such a manner that a smooth transition of the two seal regions 42 and 43 into each other is achieved, so that there is no abrupt change in the seal cross-section.

Figure 6:
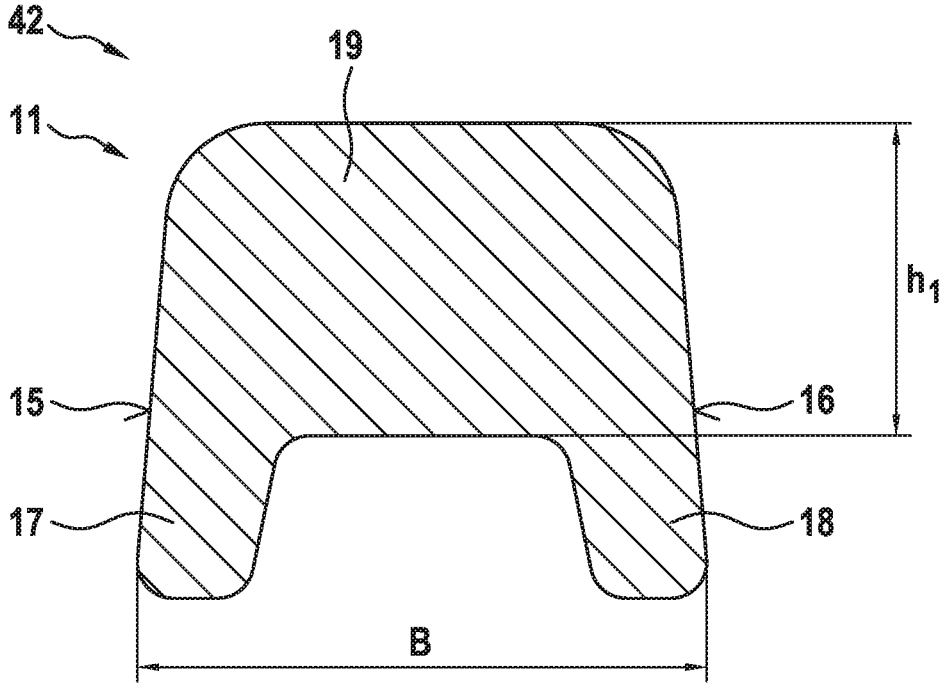
FIG. 6 shows a sectional view of the seal in a first seal region of the seal.

FIG. 6 shows a sectional view of the seal 11 in the first seal region 42, indicated in FIG. 5 by the cut mark A. The height $h_1$ of the connecting limb 19, which corresponds to its material thickness s1, is included in the drawing. The distance B of the sides of the seal limbs 17 and 18 facing away from each other is also indicated. The seal 11 is shown in its relaxed state.

Figure 7:
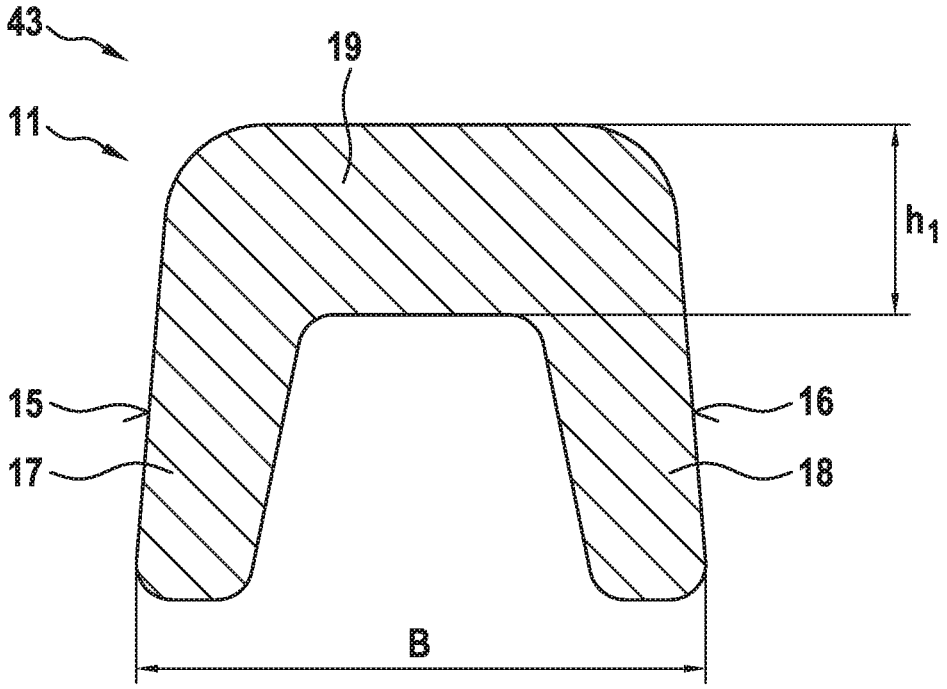
FIG. 7 shows a sectional view of the seal in a second seal region of the seal.

FIG. 7 shows a sectional view of the seal 11 in the second seal region 43, wherein the corresponding point in FIG. 5 is indicated by the cut mark B. The height $h_1$ of the connecting limb 19 and the width B are again included in the drawing. It can be seen that the seal 11 preferably has a greater width B in the second seal region 43 than in the first seal region 42. However, in contrast, the height $h_1$ for the second seal region 43 is less than for the first seal region 42.

In other words, the height $h_1$ has a first value in the first seal region 42 and a second value in the second seal region 43, wherein the second value is less than the first value. Additionally or alternatively, the width of the seal 11 in the first seal region 42 has a first value and has a second value in the second seal region 43, wherein the second value is greater than the first value.

By way of example, the height $h_1$ in the first seal region 42 relative to the height $h_1$ in the second seal region 43 is at least 101%, at least 102%, at least 103%, at least 104% or at least 105%. However, this ratio may also be greater—at least 110%, at least 120%, at least 130%, at least 140% or at least 150%. Additionally or alternatively, the width B in the first seal region 42 with respect to the width B in the second seal region 43 is preferably at most 90%, at most 80%, at most 75%, at most 70%, at most 60% or at most 60% or at most 50%.

In particular, the values for the distance B and the height $h_1$ are selected in such a manner that for the seal regions 42 and 43 the spring action of the seal 11 in the direction of its width B—that is, when the seal 11 is mounted between the machine housing 4 and the axial washer 7 and/or 8—is the same.

Figure 8:
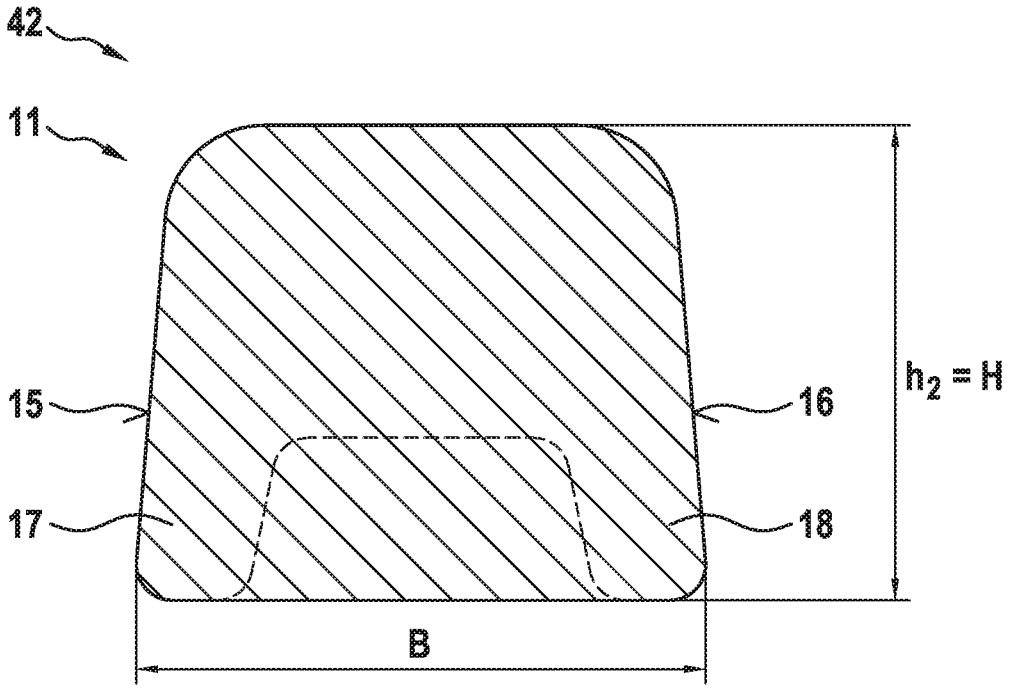
FIG. 8 shows a sectional view of the seal in an alternative embodiment of the first seal region.

FIG. 8 shows a schematic sectional view of an alternative embodiment of the first seal region 42. It can be seen that the connecting limb 19 exists at the most in imaginary form, and the two seal limbs 17 and 18 are connected to each other over the entire height H of the seal 11, such that they do not have any unconnected free ends. In this case, the height h2 of the seal limb 17 and 18 is preferably the entire height H. The described configuration can alternatively also be included in the second seal region 43. Of importance, however, is that the shape of the seal 11 described initially is present in at least one of the seal regions 42 and 43, particularly with seal limbs 17 and 18 which are connected to each other by the connecting limb 19 and which each have a free end on their side facing away from the connecting limb 19.

What is claimed is:

1. A geared fluid machine comprising:

a machine housing; and a first gearwheel and a second gearwheel meshing with the first gearwheel, the first gearwheel and the second gearwheel each rotatably mounted in the machine housing with respect to a respective axis of rotation;

at least one axial washer arranged in the machine housing with axial play, the at least one axial washer having a first washer side facing away from the first and second gearwheels; and a circumferential seal surrounding a pressure field and contacting and sealing against a first bearing surface of the at least one axial washer on a first seal side of the circumferential seal, the circumferential seal including a second seal side contacting and sealing against a second bearing surface of the machine housing, the circumferential seal being at least partially U-shaped in section, and having first and second spaced apart seal limbs, the first seal limb lying against the first bearing surface, the second seal limb lying against the second bearing surface, the circumferential seal further including a connecting limb connecting the first seal limb and the second seal limb, wherein the circumferential seal, in section, is symmetric with respect to a symmetry plane extending through the connecting limb at a distance from the first and second seal limbs, and wherein each of the first and second seal limbs, in section, is delimited on an inner surface facing the other of the first and second seal limbs by a first imaginary line, and on an outer surface facing away from the other of the first and second seal limbs by a second imaginary line, wherein the first imaginary line and the second imaginary line are angled toward each other when the seal is in a relaxed state.

2. The geared fluid machine according to claim 1, wherein the circumferential seal is made of a uniform, elastic material, and/or is designed with no support ring.

3. The geared fluid machine according to claim 2, wherein the circumferential seal is made of polyurethane.

4. The geared fluid machine according to claim 1, wherein the first and second seal limbs, in section and when the circumferential seal is in the relaxed state, have free ends sharply inclined away from each other in a direction facing away from the connecting limb.

5. The geared fluid machine according to claim 1, wherein the connecting limb, in section, has at least on a side remote from the first and second seal limbs an extension in an axial direction with respect to one of the axes of rotation which is less than a distance between the first bearing surface and the second bearing surface when the axial washer is lying against the machine housing.

6. The geared fluid machine according to claim 1, wherein free ends of the second sides of the first and second seal limbs have a greater spacing from one another than a distance between the first bearing surface and the second bearing surface when the circumferential seal is in the relaxed state.

7. The geared fluid machine according to claim 1, wherein the connecting limb, in section, is rectangular and has at least one chamfer or one round edge on its side remote from the first and second seal limbs.

8. The geared fluid machine according to claim 1, wherein the connecting limb has a radial extension in a radial direction, in section, which is greater than an axial extension of either the first seal limb or the second seal limb in an axial direction.

9. The geared fluid machine according to claim 1, wherein free ends of the first and second seal limbs, in section, have at least one rounding which is between the first imaginary line and the second imaginary line, the at least one rounding extending from the first imaginary line to the second imaginary line.

10. The geared fluid machine according to claim 1, wherein the circumferential seal has at least a first seal region and at least a second seal region, wherein the first seal region and the second seal region have different seal cross-sections.

11. The geared fluid machine according to claim 10, wherein a distance between free ends of the second sides of the first and second seal limbs, when the circumferential seal is in a relaxed state, is of a first value in the first seal region and a second value in the second seal region which is different from the first value.

12. The geared fluid machine according to claim 10, wherein a height of the connecting limb has a first value in the first seal region and has a second value in the second seal region which is different from the first value.

13. The geared fluid machine according to claim 10, wherein the first seal region and second seal region transition into each other via a transition region.

14. The geared fluid machine according to claim 10, wherein the first seal region and the second seal region are connected to each other via a bend, wherein the bend has a greater curvature than the first seal region and the second seal region.

15. The geared fluid machine according to claim 1, wherein the circumferential seal is designed without a support ring.

16. The geared fluid machine according to claim 1, wherein each of the first and second seal limbs has a maximum thickness perpendicular to a height of the connecting limb, the height being greater than the maximum thickness.

* * * * *